United States Patent [19]

Power

[11] Patent Number: 4,986,047

[45] Date of Patent: Jan. 22, 1991

[54] HEAD TRACK SYSTEM AND METHOD

[75] Inventor: Richard S. Power, Indianapolis, Ind.

[73] Assignee: Interior Creators, Inc., Indianapolis, Ind.

[21] Appl. No.: 475,170

[22] Filed: Feb. 5, 1990

Related U.S. Application Data

[63] Continuation of Ser. No. 53,159, May 21, 1987, Pat. No. 4,899,509.

[51] Int. Cl.[5] ..... E04H 3/00

[52] U.S. Cl. ..... 52/238.1; 52/241; 52/242; 52/716

[58] Field of Search ..... 52/238.1, 241, 242, 52/243, 464, 468, 483, 716, 732, 741, 254, 255, 354, 355, 361, 364, 365, 367, 368, 371, 376

*Primary Examiner*—David A. Scherbel
*Assistant Examiner*—Creighton Smith
*Attorney, Agent, or Firm*—Woodard, Emhardt, Naughton, Moriarty & McNett

[57] ABSTRACT

A head track and partition system using such head track and method of installing the same. The head track includes a horizontal web, a pair of vertical flanges extending downward from the web, and a pair of horizontal coplanar flanges extending laterally outward from the web. The horizontal flanges have a free edge and a width greater that the thickness of a sheet of wall panel to be positioned therebelow, thereby creating an exposed flange portion extending outwardly above such wall panel. The exposed flange portion acts both to shield ceiling tiles from slopping of excess joint compound applied to the top end of the wall panel, and to form a cosmetic appearance along the interface of the partition wall and ceiling which is uniform with the T-bars and L-bars of the ceiling grid. The partition system is assembled in few steps, preferably using a head track fabricated at low cost.

13 Claims, 5 Drawing Sheets

HEAD TRACK SYSTEM AND METHOD

This applicator is a continuation of application Ser. No. 53,159, filed May 21, 1987, now U.S. Pat. No. 4,899,509.

BACKGROUND OF THE INVENTION

This invention relates generally to the field of partition wall construction, and more specifically to partition systems employing head tracks for interconnection of a suspended ceiling grid and partition walls.

It is general practice in the preparation of commercial office space and similar areas to present the tenant with a bare floor slab end perimeter walls, typically covered by a ceiling grip which covers the entire floor space. This floor space area is then partitioned off in a manner as pleases the tenant to form the spaces as required for the operation of his business. Typically the ceiling grid pattern includes a series of main T-bars and cross T-bars suspended form the main structural ceiling by hangar wires or other hangers. The T-bars are arranged to form an overhead grid work on which rectangular ceiling tiles and other fixtures are supported. The edges of the ceiling tiles rest on the flanges of the T-bars and are easily removable to provide convenient access to the area above the suspended ceiling.

The ceiling grid is supported on the perimeter walls using a component commonly referred to as "ceiling mold" or "ceiling angle" or "L-bar". This is an L-shaped angle having a vertical leg which lies along the exterior wall and a horizontal leg or lip which projects out from the wall into the room and supports the grid as well as forming a cosmetic border for the wall. Typically this "ceiling mold" is normally partially up the height of the exterior walls.

The reasons for installing partition walls below an existing ceiling grid are many. In large expanses it is more cost-effective to install an entire grid pattern due to both labor and material costs. When leasing areas, if a tenant leaves, remodeling is more cost-effective because of minimal ceiling patches, and because demolition and construction is easier for both enlarging or decreasing the side of the desired area. Of major concern, however, is the development of an attractive yet cost-effective material which would insure both an attractive finished appearance to match the perimeter walls as well as provide a structurally sound surface for anchoring the wall members and a finishing edge for the joint between the existing ceiling grid work and the wall partition.

When the interior partitions are erected, a common practice is to attach a floor track having a "U" cross section to the floor, attach a head track having an inverted "U" cross section to the ceiling grid above the floor track, mount vertical wall studs between the head track and floor track, then attach drywall panels to both sides of the studs, and finally attach a separate trim piece on said side of the partition, at the top of the respective wall panels. The trim piece is typically an L-bead, such as shown in FIG. 1 of U.S. Pat. No. 4,074,478, or a series of outwardly flanged "L" shaped trim pieces attached to the face of the drywall (shown in U.S. Pat. 4,598,516), or a "T" shaped piece positioned behind the drywall (shown in When the interior partitions are erected, the common practice is to first attach a head track with an inverted "U" cross section to the ceiling, then mount vertical wall studs between the head track and a floor track, then attach drywall panels to both sides of the studs, and finally attach a separate trim piece on each side of the wall. The trim piece is typically an L-bead, such as shown in FIG. 1 of U.S. Pat. No. 4,074,478, or a series of outwardly flanged "L" shaped trim pieces attached to the face of the drywall (shown in U.S. Pat. No. 4,598,516), or a "T" shaped piece positioned behind the drywall (shown in U.S. Pat. No. 4,587,781). Another approach is to use a J-mold, shaped like an inverted "J" hooked over the top of the drywall.

In the case of the L-bead or J-mold, the main area of concern is the appearance of the joint between the top of the partition and the ceiling. In an L-bead or J-mold system, the drywall is typically applied so that its top edge is near the top of the head track. The L-bead or J-mold is attached in such a way that it is hooked over the upper edge of the partition, occupying the gap between the grid and the wall panel. In such a position, the bead is butted up against the underside of the ceiling tile. After placement of the mold, the finisher applies a series of coats of finishing compound to conceal the bead and give a suitable concealed appearance on the drywall for the application of paint or other wall treatment. The problem with this application is two-fold.

FIrst, in the placement of the J-mold or L-bead, many times an uneven ragged edge is left at the top which the finisher must follow. This results in a rather unsightly appearance which detracts from the overall cosmetic effect of the partition. Second, it is extremely difficult to control the drywall compound perfectly even by the most skilled of craftsmen. Therefore, where ceiling tile is in place, unless the finisher exercises excessive and painstaking care, portions of compound will slip up onto the ceiling tile and strain the tile, requiring its replacement. This, in the course of finishing large areas, results not only in lost labor time, but also costly replacements of the ceiling materials.

This problem of tile staining is addressed by modifying the add-on trim pieces to include an overhanging flange as shown in U.S. Pat. No. 4,587,781, U.S. Pat. No. 4,598,516 and U.S. Pat. No. 4,074,478. These approaches, however, have another problem—increased construction costs. The addition of separate trim pieces entails many additional and costly labor hours due to the installation of these trim pieces, resulting in twice to three times the amount of time necessary to achieve the desired results. This increase in labor is largely due to the need to screw three elongated pieces into the ceiling grid: the head track; and two trim pieces. Each is attached as a separate operation, thus involving significant duplication of effort and consequent time expenditure. Other approaches, such as shown in U.S. Pat. No. 4,361,994, simplify construction and economize on the cost, but do not offer a finished trim appearance which matches the existing ceiling grid.

Costs in the prior art are high using separate trim pieces which must be fabricated, inventoried, stored, ordered, shipped and installed. Furthermore, excessive joint compound must be used in the prior approaches due to the need to cover trim pieces mounted on the outside of the drywall such as shown in U.S. Pat. No. 4,598,516. While these trim pieces may provide a suitable joint for finishing and a cosmetic trim effect, they detract from the overall cost and time effectiveness of the project being worked on by adding a substantial amount of labor time for their installation. Also, as these are not an integral part of the partition, the fastening or securing methods used may fail.

SUMMARY OF THE INVENTION

According to one embodiment, the present invention provides a partition system, comprising a suspended ceiling having a grid of bars supporting a plurality of ceiling tiles, the bars each having a flat bottom surface; a partition framework including a plurality of spaced, upright studs; a parallel pair of upright wall panels secured to opposite sides of the partition framework, the wall panels each having a thickness and an upper edge; a head track interconnecting the grid, the partition framework and the wall panels. The head track has: (1) an elongated, horizontal web secured to the ceiling grid; (2) a pair of laterally opposed, elongated, coplanar, horizontal flanges extending from the web over the upper edges of the wall panels, the horizontal flanges each having a flat upper surface in contact with the flat bottom surfaces of the plurality of bars and further having an exposed flat bottom surface outward of the wall panels; and (3) a pair of laterally opposed, elongated, vertical flanges extending downward from the web between the wall panels and the partition framework. The partition system also comprises an exterior coating of joint compound between the upper edges of the wall panels and the horizontal flanges.

Another aspect of the present invention is a head track for interconnection of a suspended ceiling grid and a partition wall having a framework and a parallel pair of upright wall panels secured to opposite sides thereof, the head track comprising: an elongated web, the web including a planar grid contact surface; vertical flange means for attaching the framework to the head track, the flange means including a parallel pair of laterally opposed, elongated flanges extending along the length of the web perpendicular to the plane of the grid contact surface, the parallel flanges being separated by a distance at least as great as the width of the framework; and a coplanar pair of laterally opposed, elongated, horizontal flanges extending along the length of the web in the plane of the grid contact surface, the horizontal flanges each including a free edge separated laterally from a respective one of the vertical flanges by a distance greater than the thickness of a wall panel whereby a portion of each the horizontal flange remains exposed when the wall panels are attached to the head track.

Additionally, the present invention provides a novel method of assembling a partition system in a room having a floor and a ceiling grid comprising the steps of: (a) fastening to the ceiling grid a head track including an elongated horizontal web; a pair of vertical flanges extending downward from the web toward the floor; and a coplanar pair of laterally opposed, elongated, horizontal flanges extending along the length of the web, the horizontal flanges each including a free edge separated laterally from a respective one of the vertical flanges by a horizontal flange width; (b) mounting a plurality of vertically extending studs between the vertical flanges; (c) fastening the studs to at least one of the vertical flanges; (d) mounting a pair of upright wall panels to the studs with an upper portion of each of the wall panels laterally outboard a respective one of the vertical flanges, each of the wall panels having a thickness less than the horizontal flange width; and (e) applying finishing compound to the top edges of said wall panels.

A general object of the present invention is to provide an improved partition system.

Another general object of the present invention is to provide an improved head track.

Another general object of the present invention is to provide an improved method of assembling a partition wall system.

Another object of the present invention is to provide a system which provides for a significant reduction of time, effort and expense used in preparing a suitable finish joint at that area between a suspended ceiling and the top of partition walls.

Another object is to provide a simple one-step installation of the head track to solve two main areas of concern: (1) joint compound tile staining; and (2) cosmetic uniformity with the ceiling grid, while reducing costs associated with other systems.

The present invention provides a uniquely designed wall head track providing the anchoring system to a suspended ceiling grid while simultaneously providing a fastening surface for structural wall members and a trim surface for finishing of drywall that allows the finisher to perform his work in the more cost-effective and professional manner. In cases where there is existing ceiling tile in place, it protects the ceiling tiles from harm. The trim detail gives the appearance that the wall matches other existing conditions commonly found only on perimeter walls where ceiling wall mold is used to form the attractive border. The head track, because of its configuration, achieves all these desirable effects in one step, eliminating costly labor steps both in installation of trim pieces and in drywall installation and finishing.

Another object is to provide a head track which allows for easy cleaning of any drywall compound from its surface, and which cosmetically adds to the attractiveness of the ceiling. As opposed to methods using a J-mold or L-bead accessory, the present invention creates a suitable trim detail for the drywall finisher to finish to. It thereby eliminates the need for separate trim pieces at the top of the wall.

An advantage of the disclosed head track construction is that it helps support existing ceiling tile that may be warped or damaged.

The present invention reduces costly labor used in applying three different pieces; a conventional head track, and a piece of trim on both sides of the wall. Also, as the preferred form of the present invention is an integral part of the wall structure, and is all one piece, failure due to adhesion or installation problems is dramatically reduced.

Another advantage of the present invention is that virtually seamless trim piece appearance may be provided. Due to the nature of the present invention, fabrication may be accomplished using continuous sheet fed rolling techniques, now used to fabricate seamless rain gutters. This allows the installer to custom fit the head track to any length spanned by a partition wall. Thus, unsightly seams may be avoided.

The present head track and partition system provide a unique configuration which is a vastly superior system for providing a cosmetic and architecturally sound joint for finishing the top joint between a suspended ceiling and an interior partition.

These and related objects of the invention will become more apparent upon reading the following detailed description of the preferred embodiment in conjunction with the accompanying drawings.

DESCRIPTION OF THE PREFERRED EMBODIMENT

Figure 1:
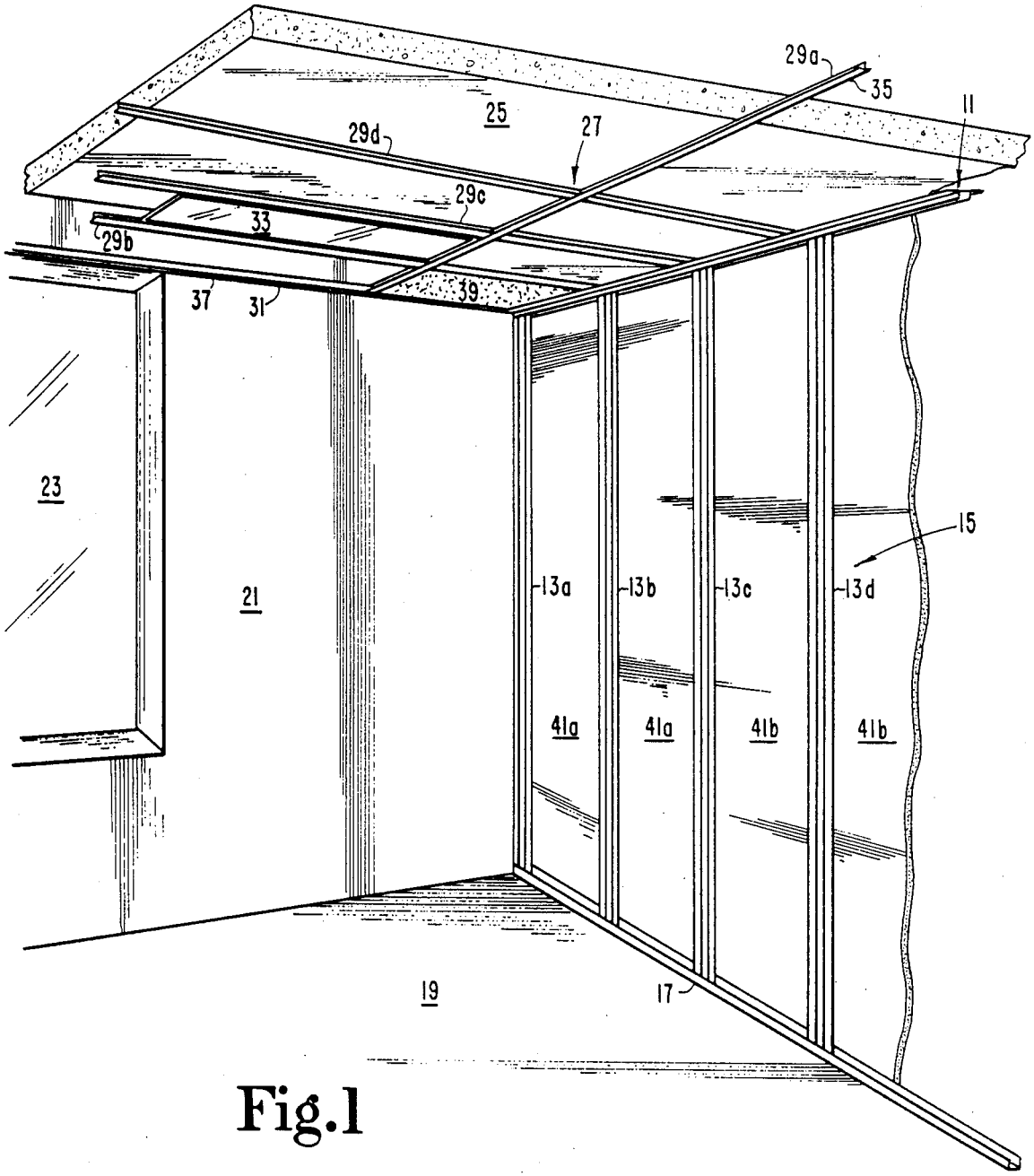
FIG. 1 is a perspective partial cutaway view of the present invention shown in a room.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
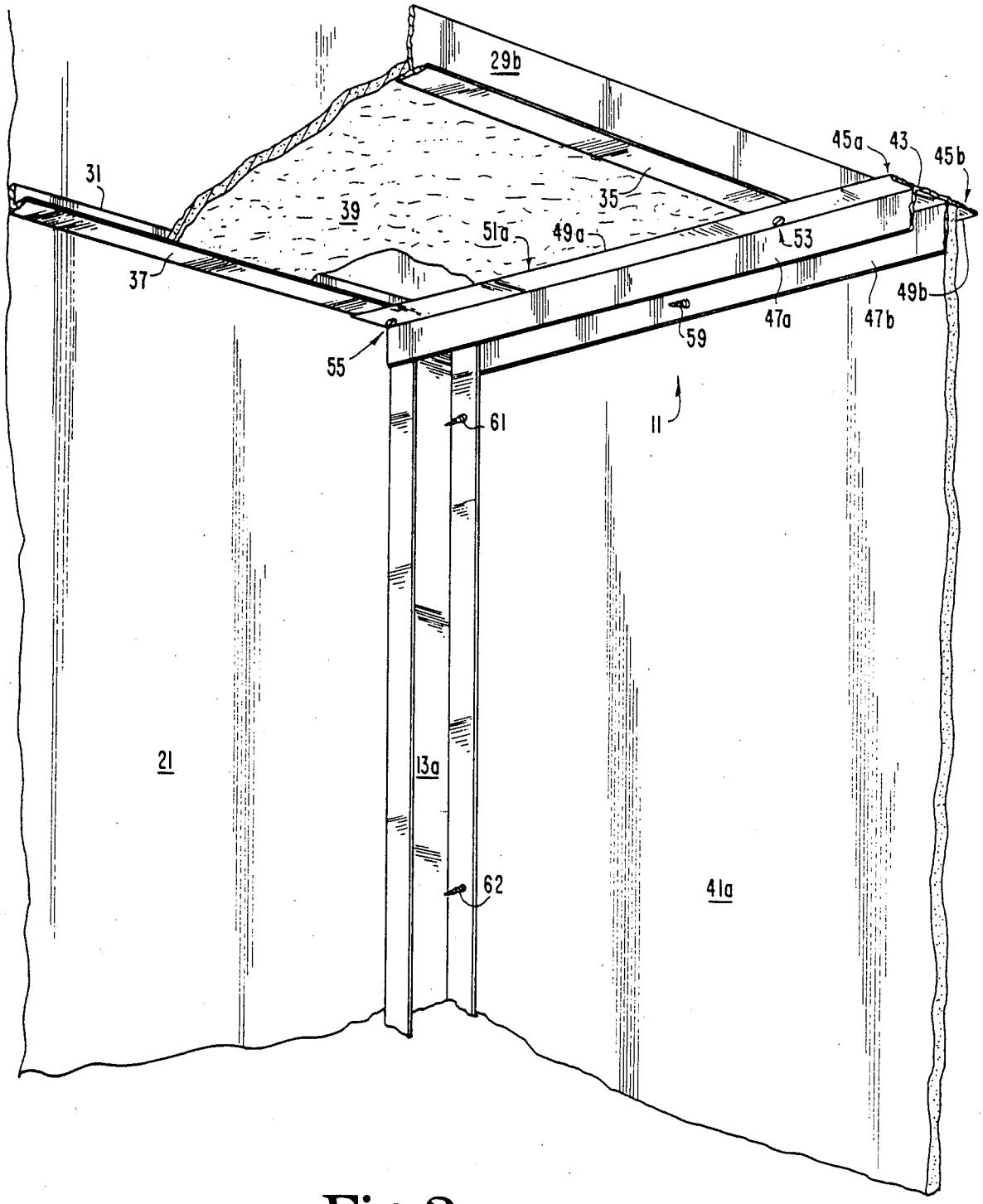
FIG. 2 is a perspective partial cutaway view of a portion of the partition system of FIG. 1.
Figure 3:
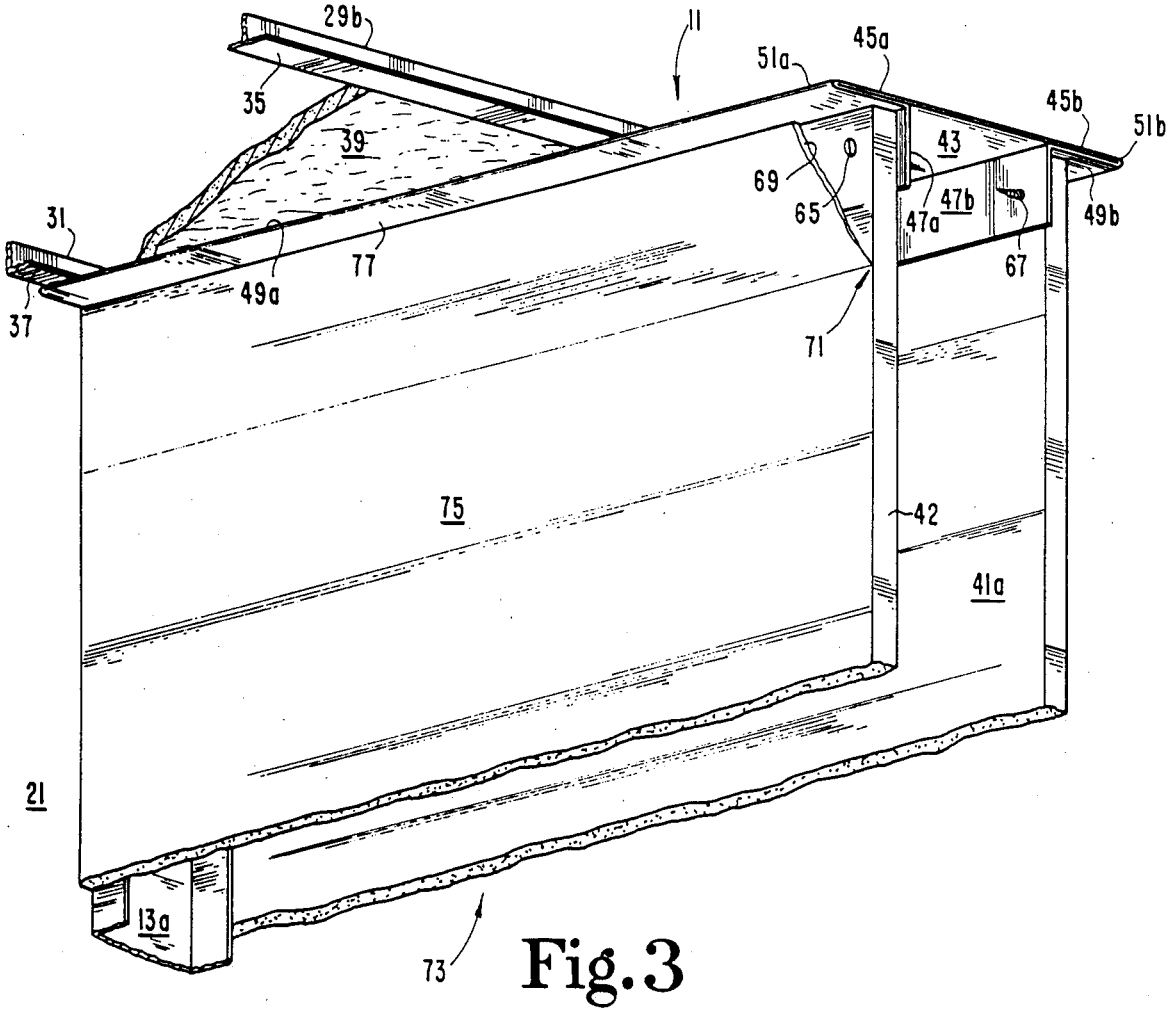
FIG. 3 is a perspective partial cutaway view of a portion of the partition system of FIG. 1, shown in an advanced stage of assembly.

Referring now to FIGS. 1, 2 and 3, head track 11 is connected to upright studs 13*a*, 13*b*, 13*c* and 13*d* which are mounted in floor track 17, which in turn is fastened to floor 19 by power-driven nails. Screws, bolts, adhesive, or other suitable means may be alternatively employed for fastening floor track 17 to floor 19. The upright studs and floor track make up partition framework 15 which, when connected to head track 11, provides a structural rigidity and support for a partition wall. The partition framework rests on floor 19 and, in FIG. 1, projects perpendicularly from wall 21, which is typically a permanent wall, such as those defining the outside of a building. Window 23 is mounted in wall 21. Structural ceiling 25 is typically made of structural steel and concrete and provides support from which ceiling grid 27 is suspended. Ceiling grid 27 is typical of ceiling grids well known in the construction industry, being suspended below the structural ceiling by wires or other tension members (not shown) and including T-bars, so called because of their inverted cross-sectional shape, such as T-bars, 29*a*, 29*b*, 29*c* and 29*d*. The T-bars have a vertical web and two horizontal T-flanges projecting therefrom. An L-bar 31 is provided as a trim piece between the exterior wall and the suspended ceiling and as a support for the ceiling grid. Ceiling tiles, such as ceiling tile 39, are positioned in the ceiling grid to be supported on all sides by T-bars and/or L-bars. Ceiling tiles are well known in the industry and are selected for both decorative and acoustical properties. Also, the ceiling grid will typically provide support for other fixtures, such as ceiling lamp 33. Note that the T-bars have a flat bottom surface, such as flat bottom surface 35; and likewise, the L-bars have a flat bottom surface, such as flat bottom surface 37. This provides for a relatively planar ceiling when the ceiling tiles are in place with such flat bottom surfaces slightly below the surface plane of the ceiling tiles.

Partition framework 15 provides support for wall panels, such as wall panels 41*a* and 41*b*. Typically, such wall panels are 4'×8' sheets of drywall, well known in the construction industry. The wall panels typically have a thickness of $\frac{5}{8}$ inch or $\frac{1}{2}$ inch. The wall panels are screwed in place to the partition framework. When a partition wall is completed, a second parallel plane of wall panels will be fastened to the partition framework (see FIG. 3) forming a sandwich with the partition framework in between two wall panel sections.

Head track 11 includes web 43, vertical flanges 47*a* and 47*b*, and horizontal flanges 49*a* and 49*b*. The two vertical flanges are laterally opposed from each other about the longitudinal central axis of the web, and are elongated, like the web. The two horizontal flanges are laterally opposed from each other and are elongated, like the web and the two vertical flanges. Flange 49*a* has a planar grid contact surface 45*a*, and correspondingly flange 49*b* has a planar grid contact surface 45*b*. The top, flat portion of the web defines the web grid contact surface (see FIG. 5). Both the horizontal flanges' planar grid contact surfaces are on top of the head track and are coplanar with the grid contact surface of web 43 and are coplanar with each other. Thus, the top portion of the web and the horizontal flanges, in the preferred embodiment, form a planar surface readily adapted to interface with the flat bottom surfaces 35 and 37 of the T-bars and L-bars on the ceiling grid. The bottom of the horizontal flanges are smooth and flat and form a flat bottom surface. The vertical flanges extend downward toward the floor and are perpendicular to the web's grid contact surface.

The head track and ceiling grid bars are fastened together by screws, such as screws 53 and 55. Screws 53 and 55 are shown in their preferred position in the horizontal flange near the vertical flange; however, such screws may also be screwed into the web to connect the head track to the ceiling grid. Thus, the head track interconnects the ceiling grid and its bars. Wall panel 41*a* (as seen in FIG. 2) is fastened to the head track by screws, such as screw 59, and to the upright studs 13*a* by screws, such as screws 61 and 62.

Free edge 51*a* is the projecting edge of horizontal flange 49*a*. Similarly, free edge 51*b* is the projecting edge of horizontal flange 49*b*. Flanges 49*a* and 49*b* are essentially flat, and their corresponding free edges are substantially linear and parallel to the planes formed by the ceiling grid and the wall panels. Note that these free edges are positioned slightly below the ceiling tiles because the T-bars and L-bars of the ceiling grid are positioned between the head track and the ceiling tiles. This spacing between the free edge and the ceiling tiles is substantially equal to the thickness of the flange portions of the T-bars and L-bars (see FIG. 2). Similar spacing exists between the ceiling tiles and the top of the head track, including planar grid contact surfaces 45*a* and 45*b*. Free edges 51*a* and 51*b* are laterally opposed from each other and outboard of vertical flanges 49*a* and 49*b*. The free edges are separated from their nearer vertical flange by a horizontal flange width, shown as $Y_1$ and $Y_2$ in FIG. 6*c*. These horizontal flange widths are greater than the thickness of the wall panel to be fastened to the head track below the horizontal flanges.

Screws, such as screws 65 and 67 (see FIG. 3), hold wall panels 41*a* and 42 securely against the head track.

An exterior coating of joint compound 69 is thereafter applied along the upper portion of the wall panel Joint compound 69 (or drywall compound) is known in the construction industry, and is typically applied in a paste form and allowed to dry to a hardened plaster-like material. The joint compound fills gaps or irregularities along the top edge of the wall board, such as wall panel 42 seen in FIG. 3. The joint compound is typically tapered or feathered from the top downward so that the joint compound forms a smooth, continuous surface with the surface of the wall panel, the joint compound leaving off and the wall panel beginning substantially as shown on FIG. 3 at joint compound-wall panel interface 71. When applying the joint compound, the horizontal flanges, such as flanges 49*a* and 49*b*, overhand the wall panel and joint compounds. This overhanging portion is shown as exposed flange portion 77, which has a flat bottom surface. The exposed flange portion exists because the horizontal flanges are greater in width $Y_1$ (see FIG. 6*c*) than the combined thickness f the wall panel 42 and the joint compound 69. As such, this exposed flange portion provides a shield, preventing joint compound paste from slipping onto the ceiling tile and causing stains thereon.

Thus, in its final assembled form, partition 73, as shown in FIG. 3, provides a sturdy and durable wall located beneath the ceiling grid. The partition has partition surface 75 which may be suitably painted or wallpapered as desired. It should be noted that in the partition's final assembled form, the joint compound will cover screws, such as screw 65 shown on FIG. 3, thus improving the partition's cosmetic appearance. It also should be noted that the wall panel and joint compound in combination (as seen in FIG. 3) cover screws, such as screws 53 and 55, seen in FIG. 2. Thus, the finished partition 73 provides a cosmetically attractive interface between the partition surface 75 and the ceiling. The exposed flange portion, such as exposed flange portion 77, is suitably dimensioned, textured and colored to match the bottoms of the ceiling grid, such as flat bottom surfaces 35 and 37. In this way, a continuous and coordinated ceiling grid structure is provided.

Figure 4:
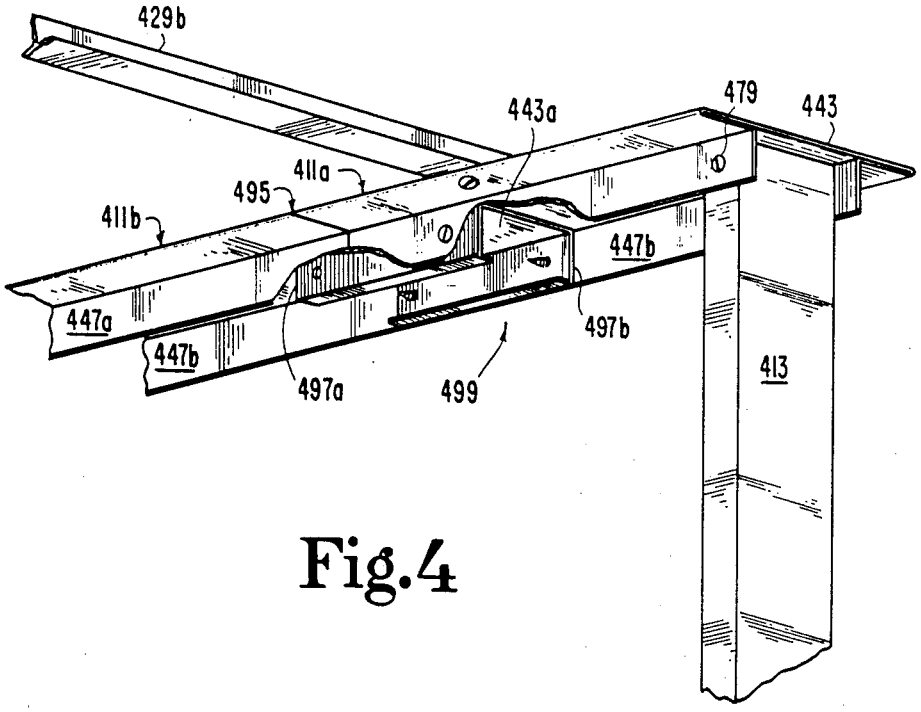
FIG. 4 is a partial cutaway perspective view of an alternative embodiment of the present invention in which two head track portions are coupled.

Referring now to FIG. 4, head track 411*a* is coupled to head track 411*b* by head track coupler 499. The head track coupler is a metal insert which bridges seam 495 between the two butted head tracks. In FIG. 4, portions of flange 447*a* are partially cutaway for drawing clarity, showing the structure and a typical mounting hole of the head track coupler. Flange 447*b* and flange 447*a* are substantially similar to flanges 47*b* and 47*a* seen in FIGS. 1–3. Similarly, upright stud 413, web 443 and T-bar 429*b* are substantially similar to the upright studs, web, and T-bars shown in FIG. 1. The head track coupler consists primarily of a head tack coupler web 443*a*, two downwardly projecting flanges, such as flange 497*a*, and two inwardly projecting subflanges connected thereto. Holes are provided to accommodate screws substantially as shown to couple the head track coupler to the respective head. tracks being joined.

Figure 5:
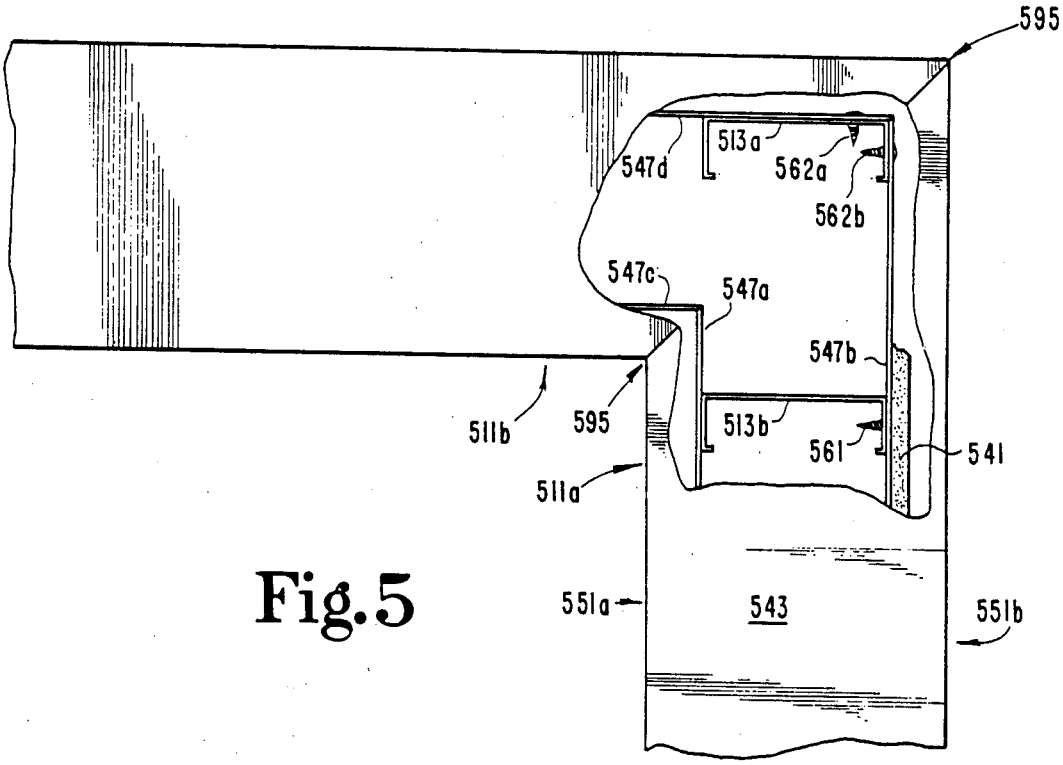
FIG. 5 is a partial cutaway plan view of an alternative embodiment of the present invention showing two portions of head track mitered to form a 90° angle.

Referring now to FIG. 5, two head tracks are shown mitered and joined along seam 595. Head tracks 511*a* and 511*b* are shown partially cutaway in top plan view and joined to form a 90° angle, such as would occur when two partitions are to be joined at 90° angles. As earlier described, the head tracks are supported by upright studs, such as studs 513*a* and 513*b*, and joined thereto by screws, such as screws 561, 562*a* and 562*b*. Note that vertical flange 547*a* abuts vertical flange 547*c*, and vertical flange 547*b* abuts vertical flange 547*d*. These vertical flanges are substantially similar to vertical flanges 47*a* and 47*b* as shown in FIGS. 1–3. Wall panel 541 is shown fastened to flange 547*b* and is partially cutaway for drawing clarity. Head track 511*a* includes web 543 which, along with the head track's two horizontal coplanar flanges, form a flat top surface between free edges 551*a* and 511*b*. This flat grid contact surface is adapted to be positioned below and in contact with the flat bottom surface of a ceiling grid. Free edges 551*a* and 551*b* define the lateralmost outward portions of the head track and are substantially similar to free edges 51*a* and 51*b* shown in FIGS. 1–3. Seam 596 is caulked as necessary to seal any gaps, and touch-up paint is applied over such caulk to provide matching color.

Figure 6A:
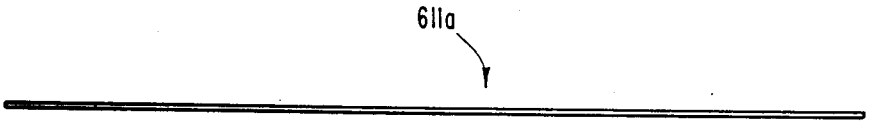
FIG. 6*a*, 6*b*, and 6*c* show, in progression, a cross-sectional view of the folding fabrication of the head track of the present invention.
Figure 6B:
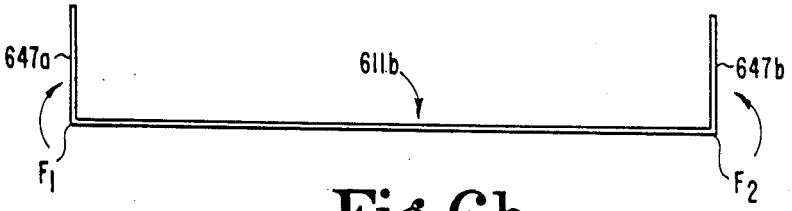
Figure 6C:
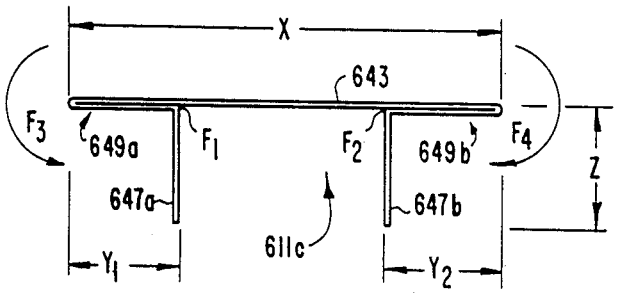

Referring now to FIG. 6*a*, 6*b*, and 6*c*, cross-sectional views of sheet metal are shown. FIG. 6*c* shows a cross-sectional view of finished head track 611*c*. FIG. 6*a* shows a cross-sectional view of a sheet of metal 611*a*, typically 0.032 gauge aluminum, to be fabricated into a head track. FIG 6*b* shows structure 611*b* in which flanges 647*a* and 647*b* were formed by folding at folds $F_1$ and $F_2$ the sheet of metal shown in FIG. 6*a*. This folding is typically accomplished by using a roll forming machine which is a coil stock fed rolling device similar to those used in fabricating spiral-D drip edge for roofing and also seamless rain gutters known in the metal folding art. The machine employs a series of rollers which, in progression, establish folds $F_1$ and $F_2$, and then subsequently establish folds $F_3$ and $F_4$ shown in FIGS. 6*b* and 6*c*. The inventor's roll forming machine was provided by Gutter Maker, Inc. of Toledo, Ohio, and is approximately sixteen feet in length. The head track may be theoretically fabricated in an almost endless length by continuously feeding the coiled sheet aluminum into the feeding machine. This allows for virtually seamless assembly corner to corner, eliminating unsightly seams such as seam 495 shown in FIG. 4. Standard sizes, typically 8', 10', 12', 14' and 16' in length, may be used for many applications. Instead of the roll forming machine, folds $F_{1-4}$ may be created in the sheet aluminum by a standard metal brake known in the metal fabricating art.

After the flanges shown in FIG. 6*b* are made from the sheet metal shown in FIG. 6*a*, folds $F_3$ and $F_4$ are made in structure 611*b* of FIG. 6*b*. In this way, the final head track is made. Folds $F_3$ and $F_4$ are 180° folds and define the free edges of horizontal coplanar flanges 649*a* and 649*b*. Note that flanges 647*a* and 647*b* remain from the folding step shown in FIG. 6*b*. Thus, the head track is fabricated by making four longitudinal folds, $F_{1-4}$, in elongated sheet material 611*a* which has been pre-cut to the proper width. Also, the thickness of the horizontal flanges is a double thickness of the sheet material due to folds $F_3$ and $F_4$, substantially equal to the thickness of the bottoms of the T-bars and L-bars of the ceiling grid. The head track's vertical flanges are a single thickness of the sheet material.

In FIGS. 6*c*, the dimensions X, $Y_1$, $Y_2$ and Z vary from model to model depending on the size and type of partition to be in place. However, for illustration purposes, nominal dimensions, in inches, for various embodiments are as follows:

| Model | X | $Y_1$ | $Y_2$ | Z |
|---|---|---|---|---|
| 1 | 5½ | 1½ | 1½ | 1½ |

-continued

| Model | X | $Y_1$ | $Y_2$ | Z |
|---|---|---|---|---|
| 2 | 5¾ | 1⅝ | 1⅝ | 1½ |
| 3 | 3½ | ½ | ½ | 1½ |
| 4 | 3¾ | ⅜ | ⅜ | 1½ |
| 5 | 5⅜ | 1½ | 1⅝ | 1½ |
| 6 | 3⅜ | ½ | ⅜ | 1½ |

In all of the above embodiments, Z is 1½ inches and the distance between flanges 647*a* and 647*b* is 2½ inches, suitably sized to accommodate upright studs. However, the horizontal flange widths ($Y_1$, $Y_2$) may differ for a single head track, allowing wall panels of different thickness to be installed on either side of the head track.

Although the head track may be fabricated by folding with four longitudinal folds as seen in FIGS. 6*a*, 6*b* and 6*c*, it is also possible to fabricate the head track of the present invention by extrusion or molding.

The partition wall is assembled by fastening a floor track 17 to floor 19 of the room, and fastening a corresponding head track 11, as described above, to an overhead ceiling grid 27. The head track and floor track are positioned in the same longitudinal direction, with the head track directly over the floor track, thus forming a plane therebetween in which the partition wall will be positioned. The floor track is typically nailed to the floor with power nails, but may be glued or otherwise secured to the floor. The head track is screwed to the T-bars and/or L-bars of the ceiling grid with screws, such as screws 53 and 55 shown in FIG. 2, driven through the horizontal flanges and/or web of the head track. Preferably, holes are pre-drilled in the field through the horizontal flange or web to facilitate easier installation of the screws.

Next, upright studs 13*a–d* are mounted, typically on 24" centers, between the head track and floor track and fastened to both. Each upright stud is, at its upper end, positioned between the two downward extending vertical flanges 47*a* and 47*b*, and then the flanges are screwed to the stud with a screw, such as screw 479 shown in FIG. 4.

Next, a wall panel, such as wall panel 41*a*, is mounted to the partition frame 15 by screws, such as screws 61 and 62, being screwed into the studs, and by screws, such as screw 65, being screwed into the head track's vertical flanges. The panel is likewise screwed into the floor track. A second wall panel, such as panel 42, is likewise mounted to the frame, forming a sandwich structure of two wall panels with the partition frame therebetween. The wall panels are mounted laterally outboard of the head track's vertical flanges. Thus, these vertical flanges are positioned between the panels and the studs.

After paneling, joint compound 69 or other suitable finishing compound is applied to the top edges of the wall panels. The compound is applied thinly so as to conserve joint compound. The joint compound is tapered or feather in thickness from the top of panel 42 downward until joint compound-wall panel interface 71 is established, forming a smooth continuous surface therebetween Excess joint compound slopped onto the bottom flat surface of exposed flange portion 77 is removed, typically by wiping with a cloth or other instrument. The finished wall is then painted, papered or otherwise surfaced.

Ceiling tiles are placed in the ceiling grid at any point in time during this assembly when such tiles are not already in place from previous construction.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A partition system, comprising:

(a) a suspended ceiling having a grid of bars supporting a plurality of ceiling tiles, said bars each having a flat bottom surface;

(b) a partition framework including a plurality of spaced, upright studs;

(c) a parallel pair of upright wall panels secured to opposite sides of said partition framework, said wall panels each having a thickness and an upper edge;

(d) a one-piece construction head track interconnecting said grid, said partition framework and said wall panels, said head track being secured to said ceiling grid and having an elongated, horizontal web;

a pair of laterally opposed, elongated, coplanar, horizontal flanges extending from said web over said upper edges of said wall panels, said horizontal flanges each having a flat upper surface in contact with the flat bottom surfaces of said plurality of bars and further having an exposed flat bottom surface outward of said wall panels; and a pair of laterally opposed, elongated, vertical flanges extending downward from said web between said wall panels and said partition framework, wherein said web, said horizontal flanges, and said vertical flanges are integral; and (e) an exterior coating of finishing compound between said upper edges of said wall panels and said horizontal flanges.

2. The partition system of claim 1 wherein said web, said pair of laterally horizontal flanges and said pair of laterally opposed vertical flanges of said head track are a unitary material.

3. The partition system of claim 1 wherein said web has a planar grid contact surface coplanar with said flat upper surface of each of said laterally opposed horizontal flanges.

4. The partition system of claim 1 wherein each of said laterally opposed horizontal flanges has a horizontal flange width greater than said thickness of each of said wall panels.

5. The partition system of claim 1 wherein said one-piece construction head track is fabricated by extrusion.

6. A one-piece construction head track for interconnection of a suspended ceiling grid and a partition wall having a framework and a parallel pair of upright wall panels secured to opposite sides thereof, said head track comprising:

an elongated web, said web including a planar grid contact surface;

vertical flange means for attaching the framework to said head track, said flange means including a parallel pair of laterally opposed, elongated flanges extending along the length of said web perpendicular to the plane of said grid contact surface, said parallel flanges being separated by a distance at least as great as the width of the framework; and a coplanar pair of laterally opposed, elongated, horizontal flanges extending along the length of said web in the plane of said grid contact surface, said horizontal flanges each including a free edge separated laterally from a respective one of said vertical flanges by a distance greater than the thickness of a wall panel whereby a portion of each said horizontal flange remains exposed when the wall panels are attached to said head track, wherein said web, said vertical flange means, and said horizontal flanges are integral

7. The head track of claim 6 wherein said web, said pair of laterally opposed horizontal flanges and said pair of laterally opposed vertical flanges are a unitary material.

8. The head track of claim 6 wherein each of said laterally opposed horizontal flanges has a horizontal flange width greater than the thickness of each of the wall panels.

9. The one-piece construction head track of claim 6 wherein said head track is fabricated by extrusion.

10. A method of assembling a partition system in a room having a floor and a ceiling grid comprising the steps of:

(a) fastening to the ceiling grid a one-piece construction head track including an elongated horizontal web;

a pair of vertical flanges extending downward from said web toward the floor; and a coplanar pair of laterally opposed, elongated, horizontal flanges extending along the length of said web and under said ceiling grid, said horizontal flanges each including a free edge separated laterally from a respective one of said vertical flanges by a horizontal flange width, wherein said web, said horizontal flanges, and said vertical flanges are integral;

(b) mounting a plurality of vertically extending studs between said vertical flanges;

(c) fastening said studs to at least one of said vertical flanges;

(d) mounting a pair of upright wall panels to said studs with an upper portion of each of said wall panels laterally outboard a respective one of said vertical flanges, each of said wall panels having a thickness less than said horizontal flange width; and (e) applying finishing compound to said top edges of said wall panels.

11. The method of claim 10 wherein each of said horizontal flanges has an exposed flat bottom surface and further comprising the step of removing excess joint compound from said flat bottom surfaces.

12. The method of claim 10 wherein said one-piece construction head track is fabricated by extrusion.

13. The method of claim 10 and further including the step of installing ceiling tile in the ceiling grid.

* * * * *

UNITED STATES PATENT AND TRADEMARK OFFICE

CERTIFICATE OF CORRECTION

PATENT NO. : 4,986,047

DATED : January 22, 1991

*INVENTOR(S)* : Richard S. Power

It is certified that error appears in the above-identified patent and that said Letters Patent is hereby corrected as shown below:

In block 57 of the title page, line 7, please change "that" to --than--.

In column 1, line 4, please change "applicator" to --application--.

In column 1, line 16, please change "grip" to --grid--.

In column 1, line 21, please change "form" to --from--.

In column 1, line 59, please change "said" to --each--.

In column 2, line 26, please change "FIrst" to --First--.

In column 2, line 35, please change "strain" to --stain--.

In column 5, line 42, please delete "a", first occurrence.

In column 5, line 54, please delete the first comma.

In column 6, line 30, please change "on" to --of--.

In column 7, line 2, please insert a period after "panel".

In column 7, line 15, please change "overhand" to --overhang--.

In column 7, line 16, please change "compounds" to --compound--.

In column 7, line 20, please change "f" to --of--.

In column 7, line 54, please change "tack" to --track--.

In column 7, line 59, please delete the first period.

UNITED STATES PATENT AND TRADEMARK OFFICE

CERTIFICATE OF CORRECTION

PATENT NO. : 4,986,047

DATED : January 22, 1991

INVENTOR(S) : Richard S. Power

It is certified that error appears in the above-identified patent and that said Letters Patent is hereby corrected as shown below:

In column 8, line 60, please change "FIGS." to --FIG.--.

In column 9, line 64, please insert a period after "therebetween".

In column 10, line 46, please insert --opposed-- after "laterally".

In column 11, line 15, please insert a period after "integral".

Signed and Sealed this

Eleventh Day of August, 1992

*Attest:*

DOUGLAS B. COMER

*Attesting Officer*

*Acting Commissioner of Patents and Trademarks*